United States Patent [19]

Tomlinson et al.

[11] Patent Number: 4,787,466

[45] Date of Patent: Nov. 29, 1988

[54] CUTTING COMPONENT

[76] Inventors: Peter N. Tomlinson, 315 Endford Road, Mondeor, Johannesburg, Transvaal, South Africa; Klaus Tank, 9 Warbleton Avenue, Essexwold, Johannesburg, Transvaal, South Africa

[21] Appl. No.: 105,094

[22] Filed: Oct. 5, 1987

[30] Foreign Application Priority Data

Oct. 6, 1986 [ZA] South Africa ..... 86/7606

[51] Int. Cl.[4] ..... E21B 10/46

[52] U.S. Cl. ..... 175/329; 175/410

[58] Field of Search ..... 175/329, 410, 411, 374, 175/375; 76/108 A, DIG. 12; 299/79, 91; 408/144, 145; 51/307, 293

[56] References Cited

U.S. PATENT DOCUMENTS 4,244,432 1/1981 Rowley et al. ..... 175/410 X
4,382,477 5/1983 Barr ..... 175/410
4,505,721 3/1985 Almond et al. ..... 175/410
4,520,881 6/1985 Phaal ..... 175/410 X
4,679,639 7/1987 Barr ..... 175/410 X

*Primary Examiner*—Stephen J. Novosad
*Attorney, Agent, or Firm*—Scully, Scott, Murphy & Presser

[57] ABSTRACT

A cutting component comprising:

(a) a composite abrasive compact comprising an abrasive compact bonded to a cemented carbide support;

(b) an elongate, cylindrical pin having end surfaces and a side surface;

(c) a recess for receiving the composite abrasive compact sloping from one end surface of the pin to the side surface;

(d) the composite abrasive compact being located in the recess and bonded to the pin such that the abrasive compact presents a cutting edge for the cutting component and the abrasive compact lies wholly within the side surface of the pin and an imaginary extension thereof; and (e) a groove in the recess which spaces the abrasive compact from the pin.

2 Claims, 1 Drawing Sheet

CUTTING COMPONENT

BACKGROUND OF THE INVENTION

This invention relates to a cutting component.

Cutting components for tools such as drill bits and mining picks utilizing composite abrasive compacts have been described in the literature and have been used commercially. Such cutting components comprise an elongate pin of cemented carbide which is bonded to composite abrasive compact, bonding occurring through the carbide support of the composite abrasive compact. Bonding between the carbide support and the elongate pin is achieved by a suitable braze.

Composite abrasive compacts consist of abrasive compacts bonded to cemented carbide supports. Bonding between the compact and the carbide support may be direct, i.e. without the interposition of a braze layer. Alternatively, a bonding braze layer may be provided between the compact and the carbide support.

Abrasive compacts may be diamond or cubic boron nitride abrasive compacts and they are well known in the art. They consist of a polycrystalline mass of bonded abrasive particles, the abrasive particle content of which is at least 70 percent by volume and generally 80 to 90 percent by volume. The abrasive particles may be self-bonded without the aid or use of a second or bonding phase.

SUMMARY OF THE INVENTION

According to the present invention there is provided a cutting component comprising:

(a) a composite abrasive compact comprising an abrasive compact bonded to a cemented carbide support;

(b) an elongate, cylindrical pin having end surfaces and a side surface;

(c) a recess for receiving the composite abrasive compact sloping from one end surface of the pin to the side surface;

(d) the composite abrasive compact being located in the recess and bonded to the pin such that the abrasive compact presents a cutting edge for the cutting component and the abrasive compact lies wholly within the side surface of the pin and an imaginary extension thereof; and (e) a groove in the recess which spaces the abrasive compact from the pin.

DETAILED DESCRIPTION OF THE INVENTION

Figure 1:
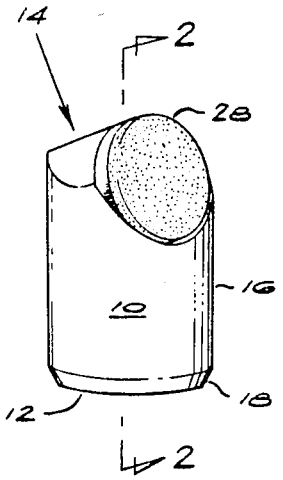
FIG. 1 illustrates a perspective view of an embodiment of the invention.
Figure 3:
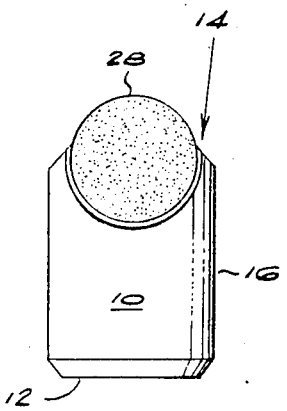
FIG. 3 illustrates a front view of the embodiment of FIG. 1.

The cutting component of the invention may be used in a variety of abrasive tools such as drill bits and mining picks. The cutting component will be located in a recess in the working surface of the tool such that the cutting edge of the compact provides a cutting edge for the tool.

The composite abrasive compact may be any known in the art. It is preferably a diamond composite abrasive compact.

The elongate pin will preferably be a right-circular cylindrical pin and will preferably be made of cemented carbide. Bonding between the composite abrasive compact and the elongate pin will occur through the cemented carbide support of the compact and will be achieved by means of a suitable braze. The braze may be a high temperature braze having a melting point above 800° C. or a braze having a somewhat lower temperature.

An embodiment of the invention will now be described with reference to the accompanying drawings. Referring to these drawings, there is shown a cutting component for a drill bit or a mining pick comprising an elongate right-circular cylindrical pin 10 having end surfaces 12 and 14 and a side surface 16. The end surface 12 is chamfered at 18. A recess 20 is formed in one end of the pin. The recess slopes from the end surface 14 to the side surface 16.

Located in the recess 20 and bonded to the cemented carbide pin is a composite abrasive compact 22. The composite abrasive compact consists of an abrasive compact layer 24 bonded to a cemented carbide support 26. The cemented carbide support 26 is bonded to the elongate pin 10 by means of a suitable braze. The edge 28 of the abrasive compact provides a cutting edge for the component.

Figure 2A:
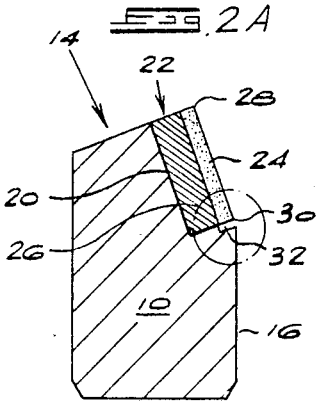
FIG. 2A is a section along the line 2—2 of FIG. 1.
Figure 2B:
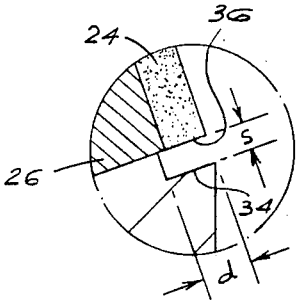
FIG. 2B is an enlarged detail of the dotted circle portion of FIG. 2A.

The abrasive compact lies wholly within the side surface 16, and an imaginary extension thereof, of the elongate pin. In particular, the lower edge 30 of the abrasive compact lies wholly within the side surface 16. To prevent the abrasive compact coming into contact with the elongate pin 10, a groove 32 is provided around the lower edge of the recess. This is an important and essential feature of the invention because it spaces the abrasive compact from the pin. Heat damage to the temperature sensitive abrasive compact during brazing of the composite abrasive compact to the pin is minimised. It will be noted from FIGS. 2A and 2B that the depth (d) of the groove is greater than the width of the compact 24. The width (s) of the groove must be sufficient to space the compact from the pin. Generally the width will be 30 microns or more. The surface 34 of the groove need not be parallel to the lower surface 36 of the compact. In practice, some of the braze is likely to find its way into the groove 32, but this will not cause degradation of the abrasive compact.

In similar cutting components of the prior art, the composite abrasive compact, and in particular, the abrasive compact layer thereof, projects beyond the side surface 16 of the elongate pin. The projected portion of the abrasive compact tends to get caught by the material being cut, and this leads to dislodgment of the composite abrasive compact from the elongate pin. The cutting component of the invention effectively overcomes this problem.

We claim:

1. A cutting component comprising:

(a) a composite abrasive compact comprising an abrasive compact bonded to a cemented carbide support;

(b) an elongate, cylindrical pin having end surfaces and a side surface;

(c) a recess for receiving the composite abrasive compact sloping from one end surface of the pin to the side surface;

(d) the composite abrasive compact being located in the recess and bonded to the pin such that the abrasive compact presents a cutting edge for the cutting component and the abrasive compact lies wholly within the side surface of the pin and an imaginary extension thereof; and (e) a groove in the recess which spaces the abrasive compact from the pin.

2. A cutting component according to claim 1 wherein the abrasive compact is a diamond abrasive compact.

* * * * *